US009813819B2

(12) United States Patent
Zhang et al.

(10) Patent No.: US 9,813,819 B2
(45) Date of Patent: Nov. 7, 2017

(54) SPEAKER

(71) Applicants: Rui Zhang, Shenzhen (CN); Long Zhang, Shenzhen (CN)

(72) Inventors: Rui Zhang, Shenzhen (CN); Long Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/080,364

(22) Filed: Mar. 24, 2016

(65) Prior Publication Data

US 2017/0026756 A1 Jan. 26, 2017

(30) Foreign Application Priority Data

Jul. 24, 2015 (CN) ..... 2015 2 0546204 U

(51) Int. Cl.

| | |
|---|---|
| ***H04R 11/02*** | (2006.01) |
| ***H04R 9/04*** | (2006.01) |
| ***H04R 9/06*** | (2006.01) |
| ***H04R 1/28*** | (2006.01) |
| ***H04S 7/00*** | (2006.01) |

(52) U.S. Cl.

CPC ..... *H04R 9/045* (2013.01); *H04R 1/2803* (2013.01); *H04R 9/06* (2013.01); *H04S 7/00* (2013.01); *H04R 2499/11* (2013.01); *H04S 2420/01* (2013.01)

(58) Field of Classification Search

CPC ..... H04R 9/06; H04R 2499/11; H04R 9/025; H04R 31/006; H04R 9/045; H04R 1/06; H04R 9/02; H04R 2400/11; H04R 7/04; H04R 9/10; H04R 2209/022; H04R 7/20; H04R 9/063

USPC ..... 381/400, 412, 423–433

See application file for complete search history.

(56) References Cited

U.S. PATENT DOCUMENTS

| | | | | |
|---|---|---|---|---|
| 2010/0177927 | A1* | 7/2010 | Sano | H04R 9/025 381/400 |
| 2012/0170793 | A1* | 7/2012 | Jiang | H04R 9/025 381/412 |
| 2014/0056464 | A1* | 2/2014 | Li | H04R 9/025 381/400 |
| 2014/0241566 | A1* | 8/2014 | Choi | H04R 9/043 381/400 |

* cited by examiner

*Primary Examiner* — Md S Elahee
*Assistant Examiner* — Julie X Dang
(74) *Attorney, Agent, or Firm* — Na Xu; IPro, PLLC

(57) ABSTRACT

A speaker is provided in the present disclosure. The speaker includes a membrane, a voice coil connected to the membrane, and a vibration part attached on the membrane. The membrane includes a main body and a periphery portion surrounding the main body. One of the vibration part and the main body includes a protrusion protruding away from the voice coil, and the other one of the vibration part and the main body includes a recess portion recessed towards the voice coil and corresponding to the protrusion.

9 Claims, 5 Drawing Sheets

SPEAKER

FIELD OF THE DISCLOSURE

The present disclosure relates to electro-acoustic converting technologies, and more particularly, to a speaker applicable to a mobile device for producing audible sound.

BACKGROUND

Speakers are widely applied in mobile devices, such as mobile phones, tablet computers or laptop computers, for converting electrical signals into audible sounds. A related speaker includes a vibration system, a magnetic system, and a holder for holding the vibration system and the magnetic system. The magnetic system includes a magnet module, a pole plate and a yoke for receiving the magnet module and the pole plate; the magnet module is located between the pole plate and the yoke. The vibration system includes a membrane and a dome, the dome is attached on the membrane, and the membrane is further placed on the pole plate of the magnetic system.

In the above-described speaker, a main body of the membrane, the dome and the pole plate are all in a plate shape. However, with this configuration, a high frequency response effect of the speaker is low, and this may further decrease an acoustic performance of the speaker.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
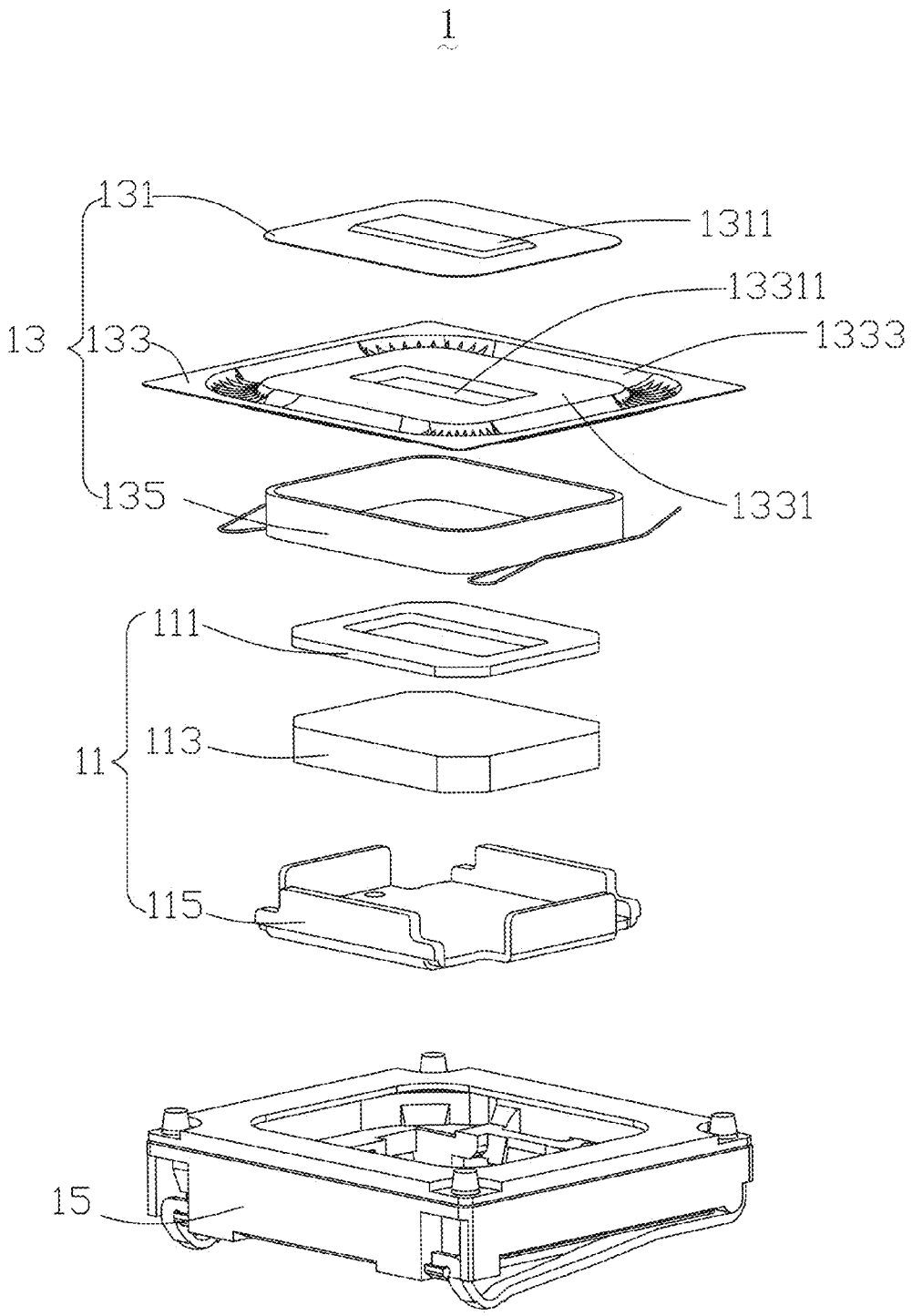
FIG. 1 is an exploded view of a speaker according to a first embodiment of the present disclosure.
Figure 2:
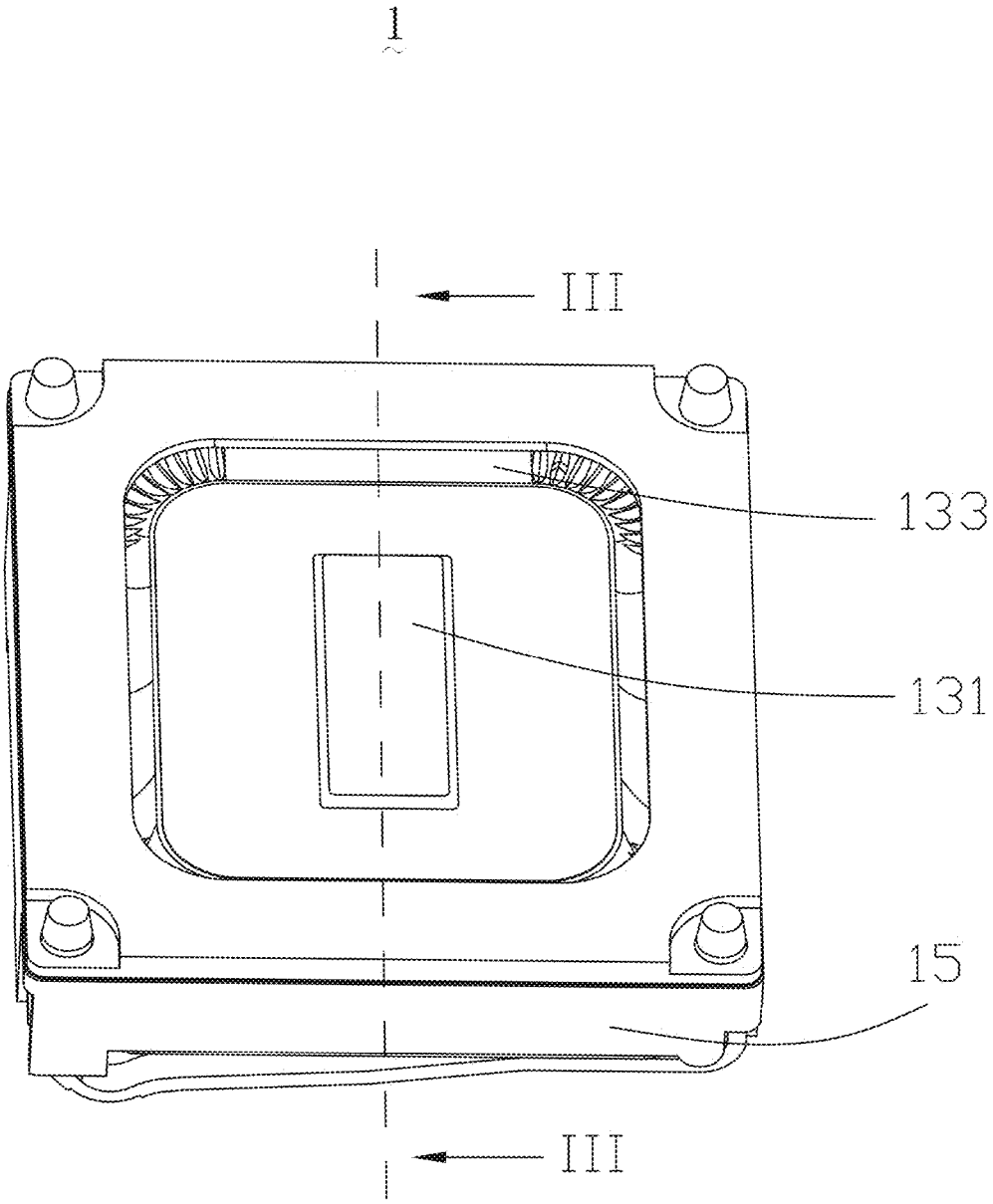
FIG. 2 is an assembled view of the speaker of FIG. 1.

Referring to FIGS. 1-2, a speaker 1 according to a first embodiment of the present disclosure is shown. The speaker 1 may be a micro speaker applicable to a mobile device such as a mobile phone, a personal digital assistant, a tablet computer, a laptop computer, or the like. The speaker 1 includes a magnetic system 11, a vibration system 13 and a holder 15 for holding the magnetic system 11 and the vibration system 13.

The magnetic system 11 includes a pole plate 111, a magnet 113 and a yoke 115. The yoke 115 includes a bottom and a plurality of sidewalls; the sidewalls extend perpendicularly from the bottom for forming a receiving space for receiving the magnet 113 and the pole plate 111. The magnet 113 is located between the pole plate 111 and the bottom of the yoke 115, and is in a plate or block shape with a plurality of side surfaces facing the sidewalls of the yoke 115. An outer size of the magnet 113 is smaller than an inner size of the receiving space, and thus magnetic gaps 117 are formed between the side surfaces of the magnetic 113 and the sidewalls of the yoke 115.

The vibration system 13 includes a vibration part 131, a membrane 133 and a voice coil 135. The voice coil 135 is suspended in the magnetic gaps 117, and an upper end of the voice coil 135 is connected to a bottom surface of the membrane 133. The membrane 133 includes a main body 1331 at a central portion thereof, and a periphery portion 1333 surrounding the main body 1331. The vibration part 131 may be a dome attached on an upper surface of the main body 1331.

Moreover, in the speaker 100 according to the present disclosure, the main body 1331 of the membrane 133 includes a recess portion 13311 recessed downwards (i.e., towards the voice coil 135), and the vibration part 131 includes a protrusion 1311 protruding upwards (i.e., away from the voice coil 135) in a corresponding region to the recess portion 13311.

Figure 3:
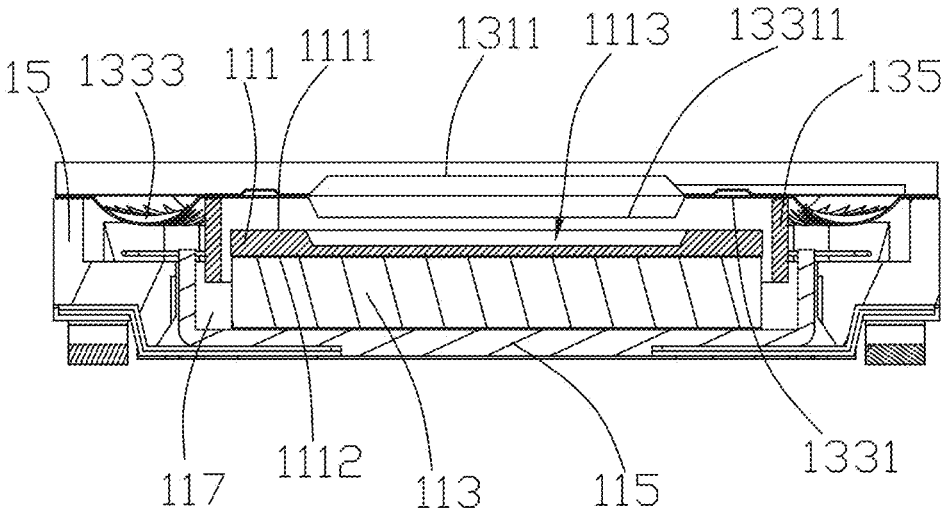
FIG. 3 is a cross-sectional view of the speaker of FIG. 2, taken along line III-III.

Referring also to FIG. 3, in the present embodiment, the pole plate 111 is located under the main body 1331 of the membrane 133, and includes a top surface 1111 adjacent to the main body 1331, and a bottom surface 1112 opposite of the top surface 1111. A groove 1113 is formed at the top surface 1111 of the pole plate 111; the groove 1113 extends downwards from the top surface 111 to the bottom surface 1112 of the pole plate 111, without penetrating the bottom surface 1112 of the pole plate 111. The groove 1113 corresponds to the recess portion 13311 of the membrane 133, and may be used to receive the recess portion 13311 when the membrane 133 is driven to perform vibration.

The speaker 1 may be assembled as below. Firstly, the bottom surface 1112 of the pole plate 111 may be attached to a main surface of the magnet 113, and the magnet 113 together with the pole plate 111 is supported by the bottom plate of the yoke 115, to form the magnetic gaps 117 between the magnet 113 and the sidewalls of the yoke 115. Secondly, the magnetic system 11 is received and held by the holder 15, and the vibration part 131 is attached on the upper surface of the main body 1331 of the membrane 133, so that the protrusion 1311 of the vibration part 131 is arranged opposite to the recess portion 13311 of the membrane 133. Furthermore, the upper end of the voice coil 135 is connected to the membrane 133 and the voice coil 135 is suspended in the magnetic gaps 117; and in addition, the periphery portion 1333 of the membrane 133 is adhered to an edge of the holder 15.

In operation, the voice coil 135 receives a driving current signal and is driven to move in the magnetic gaps 117 due to Lorentz force; a direction of the driving current signal changes periodically, which causes a movement direction of the voice coil 135 to be changed correspondingly, and therefore the voice coil 135 is driven to perform reciprocating motion in the magnetic gaps 117. The movement of the voice coil 135 further drives the membrane 133 to vibrate and produce audible sound.

Figure 4:
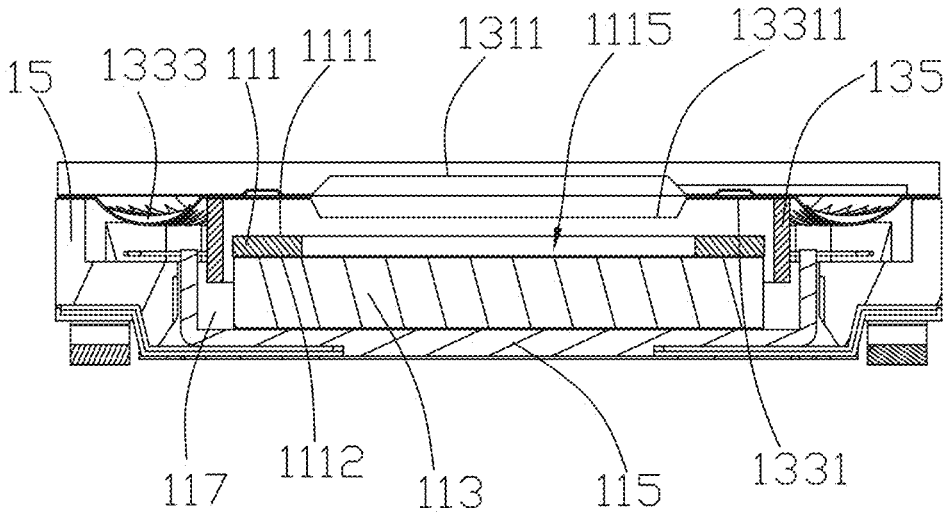
FIG. 4 is a cross-sectional view of the speaker of FIG. 2 with an alternative configuration.

Alternatively, as illustrated in FIG. 4, the groove 1113 of the pole plate 111 may be replaced by a through hole 1115; the through hole 1115 also corresponds to the recess portion 13311 of the membrane 133, and extends downwards from the top surface 111 of the pole plate 111 and penetrates through the bottom surface 1112 of the pole plate 111. The through hole 1115 may also be used to receive the recess portion 13311 when the membrane 133 is driven to perform vibration.

In the speaker 1 as provided in the present embodiment, the protrusion 1311 of the vibration part 131 and the recess portion 13311 of the membrane 133 can expend a high frequency response effect of the speaker 1 to ensure the speaker 1 has a higher cut-off frequency in a high frequency band thereof. Therefore, an acoustic performance of the speaker 1 can be improved. Moreover, the groove 1113 or the through hole 1115 formed in the pole plate 111 can provide an extra vibration space for the membrane 133; this can further improve a sensitivity of the speaker 1.

Figure 5:
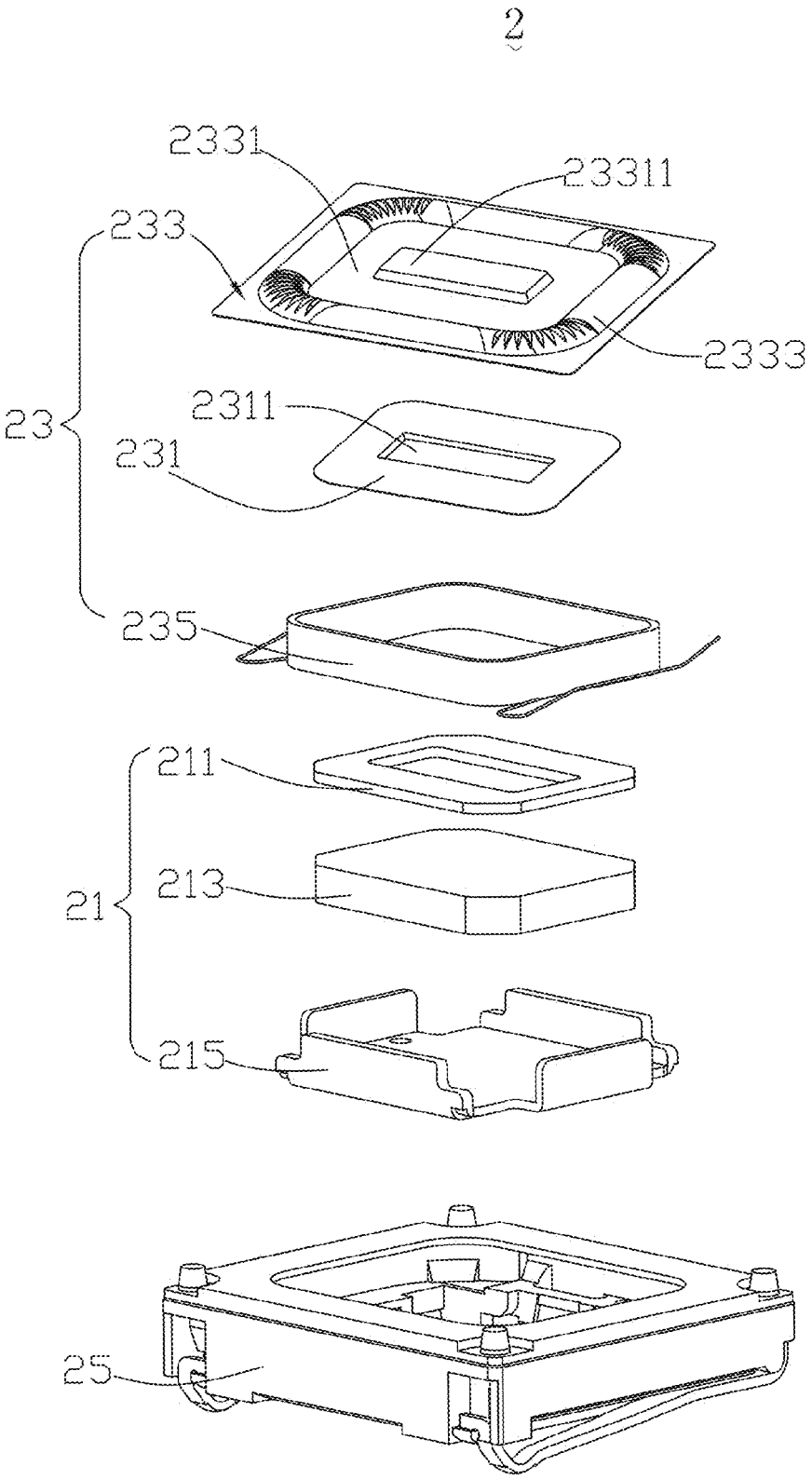
FIG. 5 is an exploded view of a speaker according to a second embodiment of the present disclosure.

FIG. 5 is an exploded view of a speaker according to a second embodiment of the present disclosure. The speaker 2 is similar to the above-described speaker 1 as illustrated in FIGS. 1-4 but have some different in configuration as described below.

Specifically, the speaker 2 also includes a magnetic system 21, a vibration system 23 and a holder 25 for holding the magnetic system 21 and the vibration system 23; the magnetic system 11 has a configuration substantially same as the magnetic system 11, and also includes a pole plate 211, a magnet 213 and a yoke 215. The vibration system 23 also includes a vibration part 231, a voice coil 235, and a membrane 233 having a main body 2331 and a periphery portion 2333 surrounding the main body 2331.

However, in the speaker 2 as provided in the present embodiment, the vibration part 231 is attached on a bottom surface of main body 2331 of the membrane 233, rather than to an upper surface thereof. Moreover, in the vibration system 23, the main body 2331 of the membrane 233 includes a protrusion 23311 protruding away from the voice coil 235, while the vibration part 231 includes a recess portion 2311 recessed towards the voice coil 235. In addition, the pole plate 211 may also include a groove or a through hole for receiving the recess portion 2311 of the vibration part 231.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a membrane comprising a main body and a periphery portion surrounding the main body;

a voice coil connected to the membrane; and a vibration part attached on the membrane;

wherein one of the vibration part and the main body comprises a protrusion protruding away from the voice coil, and the other one of the vibration part and the main body comprises a recess portion recessed towards the voice coil and corresponding to the protrusion; wherein the vibration part is attached on a bottom surface of the membrane; and the protrusion is formed at the main body of the membrane, and the recess portion is formed at the vibration part.

2. The speaker of claim 1, wherein the vibration part is attached on a top surface of the membrane; the protrusion is formed at the vibration part, and the recess portion is formed at the main body of the membrane.

3. The speaker of claim 1, further comprising a magnetic system, wherein the magnetic system comprises a magnet and a pole plate attached on the magnet.

4. The speaker of claim 3, wherein the pole plate comprises a groove corresponding to the recess portion, the groove is configured for receiving the recess portion during vibration of the membrane.

5. The speaker of claim 3, wherein the pole plate comprises a through hole corresponding to the recess portion, the through hole is configured for receiving the recess portion during vibration of the membrane.

6. The speaker of claim 3, wherein the magnetic system further comprises a yoke for receiving the magnet and the pole plate, the yoke comprises a bottom and a plurality of sidewalls extending perpendicularly from the bottom.

7. The speaker of claim 6, wherein the magnet comprises a plurality of side surfaces facing the sidewalls of the yoke for forming magnetic gaps between the magnet and the yoke.

8. The speaker of claim 7, wherein the voice coil is suspended in the magnetic gaps.

9. The speaker of claim 3, further comprising a holder for holding the magnetic system, and the periphery portion of the membrane is adhered to an edge of the holder.

* * * * *